United States Patent [19]

Chou et al.

[11] Patent Number: 4,944,654

[45] Date of Patent: Jul. 31, 1990

[54] SPLIT SCROLL FOR CENTRIFUGAL BLOWER

[75] Inventors: S.-T. Rudy Chou, Liverpool; Mark R. Hogan, Manlius, both of N.Y.

[73] Assignee: Carrier Corporation, Syracuse, N.Y.

[21] Appl. No.: 351,597

[22] Filed: May 15, 1989

[51] Int. Cl.[5] ..... F04D 29/44

[52] U.S. Cl. ..... 415/211.2; 415/204; 415/208.1; 165/126

[58] Field of Search ..... 415/203, 204, 206, 207, 415/208.1, 208.2, 208.3, 208.4, 211.2, 212.1, 182.1, 119; 98/38.9, 39.1, 36, DIG. 10; 165/122, 126

[56] References Cited

U.S. PATENT DOCUMENTS 2,093,306 9/1937 Carson ..... 165/126
3,680,328 8/1972 McCarty ..... 165/126

FOREIGN PATENT DOCUMENTS 13901 4/1971 Japan ..... 415/211.2
57345 5/1979 Japan ..... 165/126
44735 3/1985 Japan ..... 165/126

*Primary Examiner*—Edward K. Look
*Assistant Examiner*—John T. Kwon
*Attorney, Agent, or Firm*—Wall and Roehrig

[57] ABSTRACT

A split scroll diffuses and directs air upwards from the circumference of a forwardly-curved centrifugal fan to a discharge plane to one side of the fan. The scroll has a first monotonically increasing curved wall that extends from a cutoff point near the circumference of the rotor, in the direction of rotation, to the discharge plane. A second monotonically increasing curved wall extends in the opposite direction from the cutoff point up to the discharge plane. The first and second curved walls are mirror images of one another taken at the plane corresponding to the air flow tangent that passes through the cutoff point. A curved cover above the fan at the exit plane blocks line of sight noise from radiating directly from the fan rotor into the work space or living space.

11 Claims, 3 Drawing Sheets

SPLIT SCROLL FOR CENTRIFUGAL BLOWER

BACKGROUND OF THE INVENTION

The present invention relates to air-moving fans, and is more particularly directed to centrifugal fans or blowers associated with heating, ventilation, and air conditioning (HVAC) equipment. The invention specifically concerns an improved scroll or air guide for directing the air from a centrifugal fan or blower. In a specific embodiment described hereafter, a covered split scroll is beneficially applied to a packaged terminal air conditioner (PTAC) but would also be appropriate for room air conditioners or other devices.

A packaged terminal air condition (PTAC) is a unit having an indoor or interior side connected to an outdoor or exterior side through a penetration in a wall of a building. These units can be used both in summer as an air conditioner for cooling, and in the winter for heating. The PTAC generally can often employ the same motor and drive shaft to power the outdoor side and a centrifugal fan on the indoor side.

It has long been a goal in the industry to increase the air moving efficiency of these fans, both to reduce the electrical power requirement and also to reduce the noise level generated by the fan.

The centrifugal blower on the indoor side of the PTAC or other similar unit normally has a so-called scroll or flow guide to conduct the exhaust air from the blower out to an air plenum at the top front of the unit. Centrifugal fans generally require a scroll to diffuse and collect the air flow efficiently. In most HVAC systems, the air flow is discharged into a downstream system, which can be a duct, a collection of furnace heatexchanger cells, a plenum, or a variety of blockages and turns. Control of relatively high-velocity air exiting the fan is critical if pressure loss (and hence, noise) are to be minimized.

In PTAC units, relatively high velocity air leaves the centrifugal fan, is redirected upwards by the scroll, is discharged into a deck cavity or plenum, and then negotiates a ninety degree turn to exit the front of the unit. One way to reduce noise from a PTAC unit would be to enclose the noise source. The centrifugal fan in the PTAC unit is the dominant indoor noise source, but total enclosure is not feasible because of the necessity for an air inlet and for air outlet ducts. However, a logical compromise would be partial enclosure of the fan or blower to eliminate any line-of-sight noise radiation.

Another approach to noise reduction involves minimizing air pressure requirements imposed on the fan, that is, increasing air moving efficiency. This would permit a lower pressure-rise fan, and hence a quieter fan, to replace the existing fan without loss of air handling capacity.

However, prior to this invention, no suitable adaptation has been proposed for centrifugal blowers.

OBJECTS AND SUMMARY OF THE INVENTION

Accordingly, it is an object of this invention to provide a centrifugal blower and scroll assembly which overcomes the drawbacks of the prior art.

It is a more particular object of this invention to provide a scroll for a centrifugal fan or blower to increase its efficiency and to lower the noise level associated with it.

In accordance with one aspect of this invention, a centrifugal blower assembly comprises a centrifugal fan rotor and a scroll air guide to direct air exiting the rotor to the plenum, which is at an exit plane at one side of the rotor. In any centrifugal fan, air will normally exit the fan rotor at an airflow tangent which is at a predetermined angle from the circumference of the rotor, which depends on the blade or vane geometry of the fan rotor. The scroll air guide of this invention has a first curved wall whose radius from the fan rotor axis increases in the fan rotor direction from a predetermined cutoff point, closest to the rotor circumference. This radius grows larger as the wall proceeds in the direction of fan rotation towards the exit plane. There is a second curved section that extends from the cutoff point towards the exit plane in the direction against rotation. The first and second sections are substantially mirror images of one another about the plane that corresponds to the airflow tangent that passes through the cutoff point. Preferably, the first and second sections are logarithmic spirals.

In a principal embodiment there is a curved cover over the circumference of the fan rotor at the exit plane. The cover can have upper and lower surfaces that extend in logarithmic spirals from the leading edge, or cover cutoff point, at least for an initial distance.

According to another aspect of this invention, the scroll air guide can have a first curved wall proceeding from a cutoff point around the rotor towards the exit plane, and a curved baffle spaced between the rotor and the first wall. The baffle has inner and outer curved walls that extend from a baffle cutoff point and have radii from the fan axis that increase in the direction of fan rotation. The first curved wall and the baffle define primary and secondary air ducts. The curved walls and baffles may develop logarithmically.

These embodiments serve to increase the efficiency of the fan rotor, thereby permitting a lower-pressure-rise, quieter fan to be employed without loss of air handling capacity. The above and many other objects, features and advantages of this invention will be more fully appreciated from the ensuing description of a preferred embodiment, which should be considered in connection with the accompanying Drawing.

DETAILED DESCRIPTION OF THE PREFERRED EMBODIMENT

Figure 1:
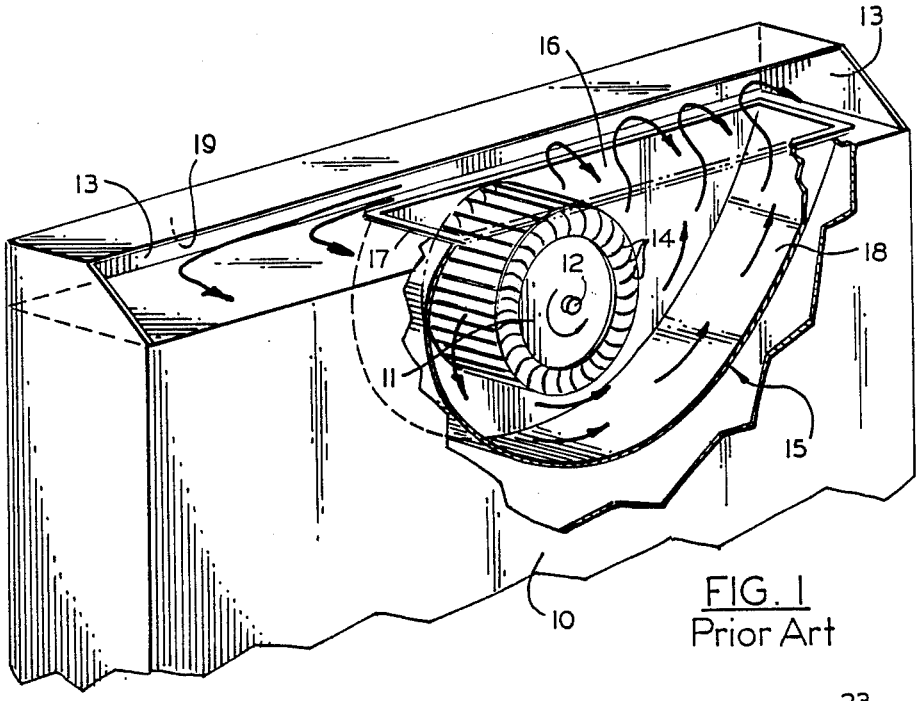
FIG. 1 Prior Art
FIG. 1 is a partial schematic elevation of pertinent parts of a standard PTAC, illustrating a centrifugal fan or blower and a conventional scroll.

With reference to the Drawing, FIG. 1 schematically illustrates the front or indoor portion of a packaged terminal air conditioning unit (PTAC), absent most of the elements that are not directly pertinent to this invention. The PTAC unit has a cabinet 10 within which there is a centrifugal fan rotor 11 that rotates about an axis 12 in the horizontal plane. Relatively high velocity air is directed from within the cabinet upwards to a deck cavity 13, which serves as a plenum, where the air impinges on the inside surface of the top deck 19 and makes a sharp right-angle turn and is expelled in the forward direction out from the cabinet through a grill (not shown)into the room.

The fan rotor 11 has blades or vanes 14 on its circumference, which in this embodiment, are forward directed. This produces a higher discharge velocity for the same size fan than is obtained from fans with rearwardly inclined vanes or blades. In this embodiment, the rotational direction of the fan rotor 11 is counter-clockwise, as viewed from the front of the cabinet 10.

A scroll or guide vane 15 within the cabinet 10 collects and diffuses the high-velocity air exiting the fan rotor 11, and directs it upward through an elongated discharge port 16 into the plenum or deck cavity 13. As is standard, this scroll 15 has a cutoff point or takeoff point 17 at the end of the discharge port 16 to the left (down-turning side) of the fan rotor 11, and a curved wall 18 that increases in diameter as it extends from the takeoff point 17 around the fan rotor 11 in the counter-clockwise direction to the other end of the discharge port 16. Here, the curved spiral wall 18 is designed to have a radius R measured from the axis 12 which substantially follows the relationship:

$R/R_1=f(\theta)$, where $f(\theta)$ is monotonically increasing, $R_1$ is the radius at the cutoff point 17, and $\theta$is the angular position on the wall 18 as measured counter-clockwise from the cutoff point 17.

However, this standard scroll can discharge only to one side of the fan, and leaves the top of the fan rotor 11 exposed, permitting noise generated on the fan to be transmitted directly into the external environment, i.e. the room work space or living space.

Figure 2:
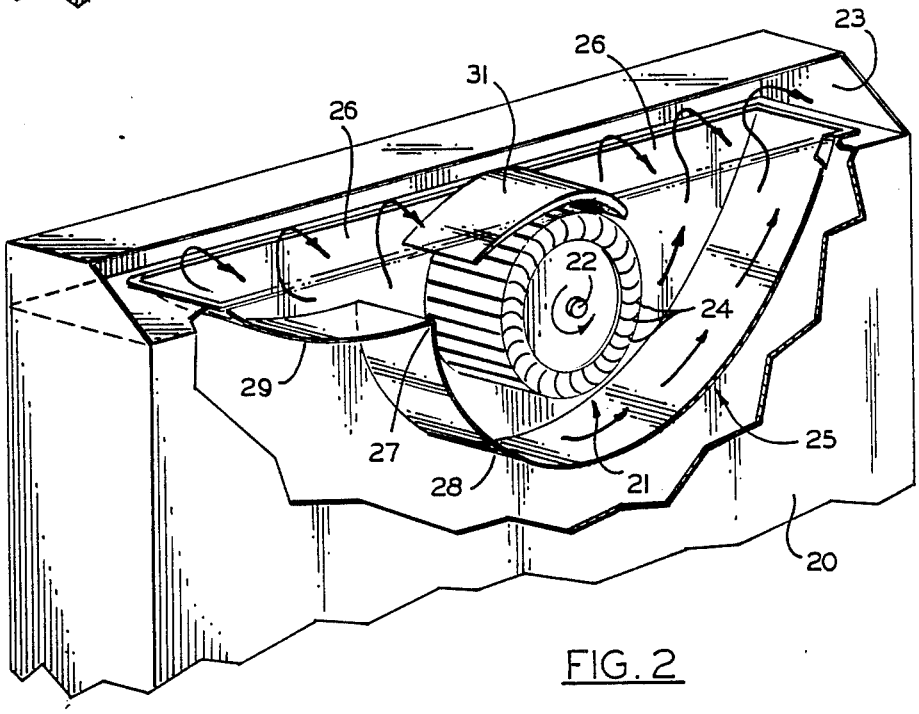
FIG. 2 is a schematic elevational view of a portion of a PTAC unit showing a fan and split scroll assembly according to a preferred embodiment of this invention with a cover over the fan.
Figure 3:
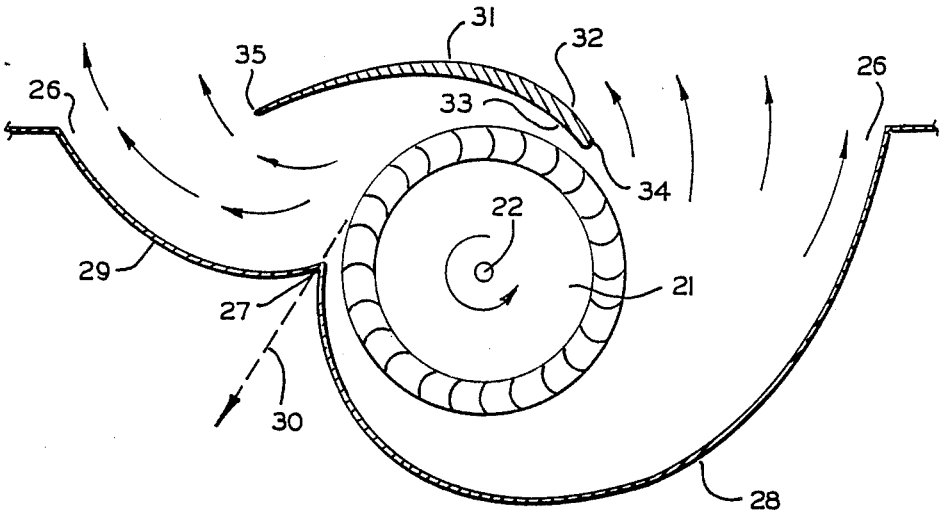
FIG. 3 is a schematic cross section of the fan and split scroll assembly of FIG. 2, with a cover.

A fan and scroll assembly according to a preferred embodiment of this invention is illustrated in FIGS. 2 and 3. Here, a cabinet 20, similar to the cabinet 10 of FIG. 1, has a centrifugal fan 21 which rotates about a horizontal axis 22, in a fashion generally similar to that of the fan 11 of FIG. 1, and discharges air into a deck cavity 23 which serves as an air plenum. This fan 21 also has vanes 24 which are forwardly directed.

Here, a split scroll 25 directs the air exiting the fan blades 24 upwards into an elongated discharge port 26 which extends on both sides of the fan rotor 21. The scroll 25 has a cutoff point 27 which is rotated from the discharge plane partly around the fan rotor 21. A first, or main monotonically increasing curved wall 28 extends from the cutoff point 27 in the counter-clockwise or rotational direction, increasing in diameter as it extends to the discharge port 26. A second monotonically increasing curved wall 29 extends from the cutoff point in the other direction, i.e., the direction against fan rotation, to the opposite end of the discharge port 26. Where the curved walls develop logarithmically, $f(\theta)=C\ln\theta$, and this shape is considered ideal for collecting air from the entire rotor or blower circumference and directing it upwards. The logarithmic or snail's-shell shape reduces the air flow velocity at the discharge plane into the deck cavity. As shown in FIG. 3, an airflow tangent 30, which represents the direction of air flowing as it exits the fan rotor relative to the circumference, passes through the cutoff point 27. The monotonically increasing curved walls 28 and 29 are specifically chosen such that they are mirror images of each other about the plane that corresponds to the air flow tangent 30 that passes through the cutoff point 27. This splits the air smoothly at the cutoff point 27 to maximize efficiency of the fan and scroll assembly, and to minimize noise as well. This air flow tangent 30 is a characteristic of the fan geometry, and is more or less invariant with fan rotor speed. The mirror image plane of the two surfaces 28 and 29 should be within about fifteen degrees of the plane of this particular air flow tangent 30.

As a variation of this split scroll, the cover 31 can be used as a noise baffle. As shown in FIGS. 2 and 3 this cover 31 guides air exiting the top of the fan rotor 21, and also blocks noise from radiating directly from the rotor 21 into the workspace or living space. This cover 31 has curved upper and lower surfaces 32 and 33 which extend from a nose or leading edge 34 to a trailing edge 35. The distance from the leading edge 34 to the trailing edge 35 is sufficient to extend beyond the exposed part of the fan 21. This reduces line-of-sight fan noise. The surfaces 32 and 33 follow airflow contours, at least for their initial portions where the air speed is highest. For the initial portion at least, the upper and lower surfaces 32 and 33 can be logarithmic spiral surfaces. To optimize efficiency, these initial portions can be more or less mirror images of one another about a plane corresponding to the air flow tangent passing through the leading edge 34, which serves as a cutoff point for the cover 31.

In this embodiment, the distances from the circumference of the fan rotor 21 to the cutoff point 27 and to the leading edge 34 of the cover, should each be about ten percent of the fan diameter.

With the structure illustrated in FIGS. 2 and 3, and described hereinabove, airflow from the fan is split to follow its normal streamlines, and enters the deck cavity 23 over generally the entire upper area of the PTAC unit. This reduces the air flow speed at the deck or plenum 23, but maintains the same volume flow rate. Thus, the covered split scroll of this invention imposes less work on the air stream. This has at least two beneficial effects: the fan rotation speed can be reduced, and/or the forward blade angle can be reduced. As a result, with the covered split scroll generally as illustrated in FIGS. 2 and 3, a 29 to 30 percent reduction in shaft power reduction has been achieved, together with a reduction in noise of 4 dBA.

Figure 4:
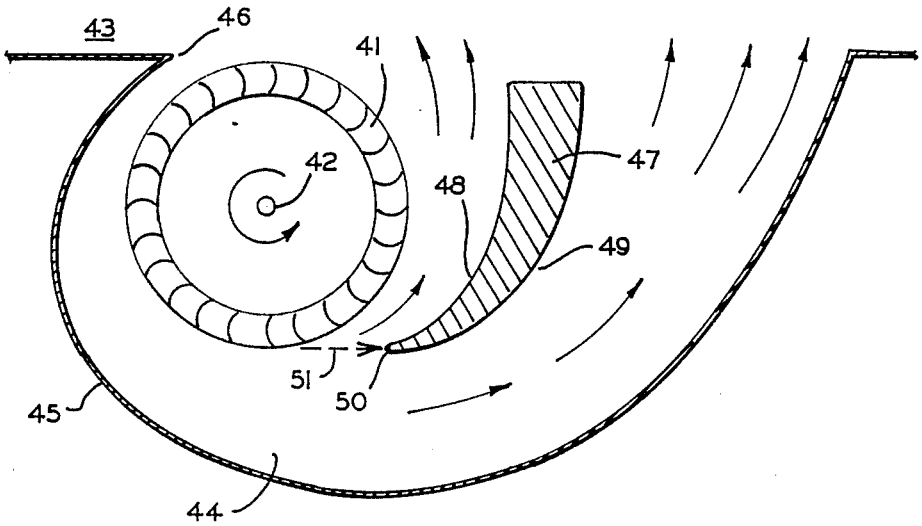
FIG. 4 is a schematic cross section of a fan and split scroll assembly according to an alternative embodiment.

A second embodiment of the split scroll of this invention is illustrated schematically in FIG. 4. Here, a fan 41 rotates counter-clockwise on an axis 42. Air flow exhausts to a deck or plenum 43 that defines an exit plane to one side of the fan 41. A scroll 44 has a first or outer wall 45 that extends from a cutoff point 46 at the plenum or discharge plane, and increases monotonically in diameter as it proceeds in the rotational direction (i.e., counter-clockwise) around the fan 41 back to the discharge plane 43.

A splitter baffle 47 is disposed between the fan rotor 41 and the outer wall 45. The splitter baffle 47 has an inside curved wall 48 that faces the fan 41 and an outside curved wall 49 that faces the first or outer wall 45. Both of these walls 48 and 49 follow monotonically increasing spirals from a cutoff point 50, which is preferably situated at a distance from the circumference of the rotor that is about ten percent of the rotor diameter.

The baffle 47 is generally wedge-shaped, and the walls 48 and 49 diverge from one another from the cutoff point 50 to the discharge plane.

Tangents of these curves 48 and 49 at least on portions thereof adjacent the cutoff point 50 should be substantially mirror images of one another about a plane corresponding to an air flow tangent 51 that passes through the cutoff point 50.

As a variation of this embodiment, a portion of the wall 48 could be extended over the fan rotor 41 to serve as a noise baffle.

The first wall 45 and the outside wall 49 of the baffle 47 together define a primary air duct, while the inside curved wall 48 of the baffle 47 defines a secondary air duct. In a preferred embodiment, about sixty to eighty percent of the air exits through the primary duct and the remaining twenty to forty percent exits through the secondary duct.

While the above embodiments involve PTAC units, it should be understood that the covered split scroll of this arrangement would be useful in room air conditioners and in other HVAC units wherever a centrifugal fan is employed.

Figure 5:
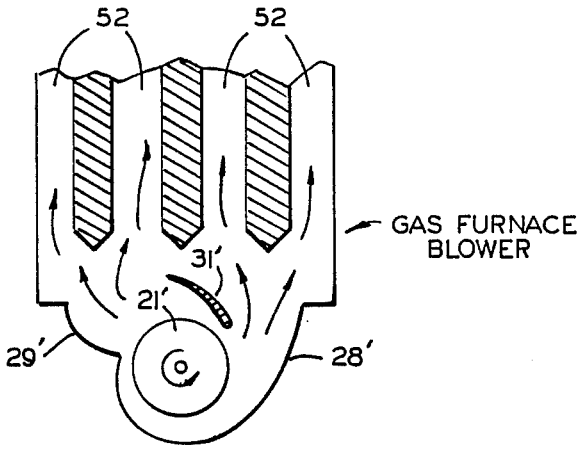
FIGS. 5 and 6 are schematic views illustrating examples of alternative applications of the covered split scroll and fan assembly of this invention.

An additional possible application of the structure of this invention is shown in FIG. 5, which comprises the blower and ductwork of a gas furnace. Here, the principal portions of the fan rotor and scroll assembly are identified with the same reference numbers as employed in FIGS. 2 and 3, but primed. In FIG. 5, air is discharged from the fan 21' and is split through the two scroll walls 28' and 29', and into a number of ducts 52 in a gas furnace. If used, the cover 31' would significantly reduce blower noise that would otherwise be carried through the hot air ducts, and it provides the requisite aerodynamic control for quiet, efficient blower operation.

Figure 6:
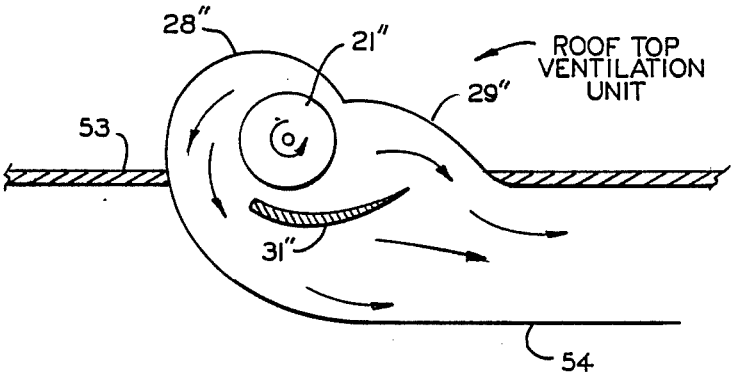

As shown in FIG. 6, a covered split scroll arrangement could also be employed with a roof top ventilation unit. Here, elements identical with those in FIG. 2 and 3 are identified with the same reference numbers, but double primed. The air exiting the fan 21'' is diffused and guided by the two monotonically increasing curved walls 28'' and 29'' through a penetration in a roof 53 where the air is directed into a sub-roof ventilation duct 54. If used, the rotor cover 31'' blocks a significant amount of the fan noise from entering the duct 54, and provides aerodynamic control.

These illustrations are intended only as examples of many possible applications where high efficiency and low noise centrifugal fan arrangement are desired.

While the invention has been described in detail with respect to certain preferred embodiments, it should be understood that the invention is not limited to those precise embodiments. Rather, many modifications and variations would be apparent to those skilled in the art without departing from the scope and spirit of this invention, as defined in the appended claims.

What is claimed is:

1. A centrifugal blower assembly comprising a centrifugal fan rotor having an axis of rotation, a circular cross section of a predetermined diameter and a plurality of vanes spaced about its circumference for blowing air centrifugally, said air exiting the fan rotor at an airflow tangent at a predetermined angle from the circumference of the rotor; and a scroll air guide to direct air exiting the rotor to an exit plane to one side of the rotor from whence the air enters an external environment, said scroll air guide including a first curved wall section having a radius from the fan rotor axis which increases monotonically in the fan rotation direction from a predetermined cutoff point closest to the rotor circumference and toward the exit plane, a second curved wall section extending from the cutoff point towards the exit plane in the direction against rotation, said first and second curved wall sections being substantially mirror images of one another about a plane corresponding to the airflow tangent that passes through said cutoff point; and a curved cover over substantially all of that part of the circumference of the fan rotor that is at said exit plane, the cover blocking any noise from the fan rotor from radiating directly out into the external environment.

2. A centrifugal blower assembly according to claim 1, wherein said cover has upper and lower surfaces that extend in the rotation direction from a cover cutoff point, said upper and lower surfaces being monotonically increasing curved surfaces at least for an initial segment.

3. A centrifugal blower assembly according to claim 2, wherein said cover upper and lower surfaces for said initial segment have tangents that are substantially mirror images of one another about a plane corresponding to the airflow tangent through said cover cutoff point.

4. A centrifugal blower assembly according to claim 1 wherein said centrifugal fan rotor vanes are forwardly directed with respect to the rotor direction of rotation.

5. A centrifugal blower assembly according to claim 1 wherein said first and second curved walls are logarithmic spiral surfaces.

6. A centrifugal blower assembly according to claim 2 wherein said upper and lower curved surfaces are logarithmic spiral surfaces.

7. A centrifugal blower assembly comprising a centrifugal fan rotor having a circular cross section of a predetermined diameter and a plurality of vanes spaced about its circumference for blowing air centrifugally, said air exiting the fan rotor at an airflow tangent at a predetermined angle from the circumference of the rotor; and a scroll air guide to direct air exiting the rotor to an exit plane to one side of the rotor, said scroll guide including a first curved wall having a radius from the fan rotor axis which increases monotonically from a predetermined cutoff point, where the first curved wall is closest to the rotor circumference, toward said exit plane; and a generally wedge-shaped baffle having an inner curved wall that extends from a baffle cutoff point and has a radius from the fan axis that increases monotonically in the direction of fan rotation, and an outer wall that curves outward monotonically from the baffle cutoff point, the baffle inner and outer walls at said cutoff point angling substantially equally to either side of a plane that corresponds to the airflow tangent through the baffle cutoff point, the inner and outer walls diverging outward substantially until they reach the exit plane, the baffle being effective to minimize turbulence both between the fan and the baffle inner wall and between the baffle outer wall and said first curved wall.

8. A centrifugal blower assembly according to claim 7 wherein said baffle cutoff point is spaced out from the fan rotor circumference a distance substantially ten percent of the diameter of the fan rotor.

9. A centrifugal blower assembly according to claim 7 wherein said baffle divides the airflow within the first wall such that about 20 to 40 percent thereof flows between the fan rotor and the baffle and 60 to 80 percent thereof flows between the baffle and the first wall.

10. A centrifugal blower assembly according to claim 7 wherein said first curved wall is a logarithmic spiral surface.

11. A centrifugal blower according to claim 10 wherein said baffle inner and outer walls each include logarithmic spiral surfaces.

* * * * *